US007461638B2

(12) United States Patent
Scheffel et al.

(10) Patent No.: US 7,461,638 B2
(45) Date of Patent: Dec. 9, 2008

(54) CONNECTOR SYSTEM

(75) Inventors: Martin Scheffel, Vaihingen (DE); Andreas Eckbauer, Nuremberg (DE)

(73) Assignee: Robert Bosch GmbH, Stuttgart (DE)

( * ) Notice: Subject to any disclaimer, the term of this patent is extended or adjusted under 35 U.S.C. 154(b) by 139 days.

(21) Appl. No.: 11/597,443

(22) PCT Filed: Mar. 27, 2006

(86) PCT No.: PCT/EP2006/061050

§ 371 (c)(1),
(2), (4) Date: Nov. 22, 2006

(87) PCT Pub. No.: WO2006/125686

PCT Pub. Date: Nov. 30, 2006

(65) Prior Publication Data

US 2007/0246016 A1 Oct. 25, 2007

(30) Foreign Application Priority Data

May 25, 2005 (DE) ..... 10 2005 024 053

(51) Int. Cl.
*F02M 61/14* (2006.01)
*F02M 55/02* (2006.01)

(52) U.S. Cl. ..... 123/470

(58) Field of Classification Search ..... 123/468–470
See application file for complete search history.

(56) References Cited

U.S. PATENT DOCUMENTS 4,203,402 A * 5/1980 Freyn ..... 123/470
4,206,725 A * 6/1980 Jenkel et al. ..... 123/470
4,485,790 A * 12/1984 Nishimura et al. ..... 123/468
4,938,193 A * 7/1990 Raufeisen et al. ..... 123/470
5,174,612 A * 12/1992 Schnell ..... 285/49
5,419,298 A * 5/1995 Nolte et al. ..... 123/508
5,499,612 A 3/1996 Haughney et al.
5,566,658 A * 10/1996 Edwards et al. ..... 123/470
5,699,770 A * 12/1997 Matsumoto et al. ..... 123/470
5,765,534 A * 6/1998 Brown et al. ..... 123/470
6,116,218 A * 9/2000 Sato et al. ..... 123/470

(Continued)

FOREIGN PATENT DOCUMENTS

DE 2 454 081 5/1976

(Continued)

*Primary Examiner*—Thomas N Moulis
(74) *Attorney, Agent, or Firm*—Kenyon & Kenyon LLP

(57) ABSTRACT

A connector system, free of transverse forces, for a fuel injection valve to be inserted into a receiving orifice into a cylinder head for connection to a fuel distributor line that encompasses a connector to a tubing line leading to a fuel reservoir, has a connecting part for connection to the tubing line. The connector system includes a holddown claw having an elongated opening that completely surrounds the fuel injection valve but allows for a tolerance compensation in the direction of the longitudinal axis of the holddown claw, and provides that the connecting part to the tubing line leading to the fuel reservoir has a tube screw fitting having an end piece. The end piece is embodied so that before the tubing line is screwed down onto the fuel distributor line, it can be moved for tolerance compensation, in a seat on the inflow-side end of the fuel distributor line, in two directions perpendicular to the extent of the tubing line.

20 Claims, 6 Drawing Sheets

U.S. PATENT DOCUMENTS

| | | | | |
|---|---|---|---|---|
| 6,196,194 | B1 * | 3/2001 | Mitchell | 123/470 |
| 6,269,798 | B1 * | 8/2001 | Takahashi et al. | 123/470 |
| 6,431,152 | B1 * | 8/2002 | Estacio | 123/470 |
| 6,769,408 | B2 * | 8/2004 | Krome et al. | 123/470 |
| 6,863,053 | B2 * | 3/2005 | Suzuki et al. | 123/470 |
| 6,928,987 | B2 * | 8/2005 | Nakamura | 123/470 |
| 7,334,572 | B1 * | 2/2008 | Diggs et al. | 123/470 |
| 2003/0154960 | A1 * | 8/2003 | Krome et al. | 123/470 |
| 2004/0020469 | A1 * | 2/2004 | Reiter et al. | 123/470 |
| 2004/0244776 | A1 * | 12/2004 | Aota | 123/470 |
| 2005/0016501 | A1 * | 1/2005 | Krause et al. | 123/470 |
| 2007/0251504 | A1 * | 11/2007 | Blank | 123/470 |

FOREIGN PATENT DOCUMENTS

| | | |
|---|---|---|
| DE | 101 12 665 | 9/2002 |
| EP | 0819846 | 1/1998 |
| JP | 2000/120508 | 4/2000 |

* cited by examiner

CONNECTOR SYSTEM

FIELD OF THE INVENTION

The present invention relates to a connector system for a fuel injection valve to be inserted into a receiving orifice into a cylinder head.

BACKGROUND INFORMATION

The German patent document DE 101 12 665 A1 discusses a mounting apparatus for mounting a fuel injection valve for direct injection of fuel into the combustion chamber of an internal combustion chamber, which apparatus encompasses a holddown that is slipped onto the fuel injection valve, the holddown being embodied as a flat component and being braced against a sleeve, fitting around the fuel injection valve, that serves for tolerance compensation upon installation of the fuel injection valve. The holddown is tightened with the aid of a corresponding tool sufficiently firmly that the fuel injection valve is not pushed out of the cylinder head by the pressure existing in the combustion chamber of the internal combustion engine.

A particular disadvantage of this mounting apparatus is the clamping effect of the clamping claw on the fuel injection valve. The energy flow produced in the fuel injection valve results in deformations and thus in changes in the stroke of the valve needle to the point of jamming, and in a compressive or flexural load on the housing parts, which are generally thin-walled and welded to one another at multiple locations. Any mounting action, for example by way of a support collar, furthermore results in an enlargement of the radial extent of the fuel injection valve and thus in an increased space requirement upon installation.

Tolerance compensation between the injection valve and the fuel distributor line is implemented by the fact that the tubing line is pulled forcibly into the desired position, which causes a deformation of the tubing line. The transverse forces acting on the injection valve in that context are received by the injection valve. The large forces acting on the fuel injection valve can moreover cause the fuel injection valve to be pushed so strongly into the receiving orifice of the cylinder head that beads form, and the fuel injection valve becomes caught in these beads, complicating further tolerance compensation due to lack of movability in the cylinder head.

SUMMARY OF THE INVENTION

The connector system according to the exemplary embodiment of the present invention for a fuel injection valve to be inserted into a receiving orifice into a cylinder head, for connection to a fuel distributor line that encompasses a connector to a tubing line leading to a fuel reservoir, having a connecting part for connection to the tubing line and having the characterizing features of the main claim, has, in contrast, the advantage that no excessive transverse forces that damage the valve are effective upon installation onto the fuel injection valve.

The tolerance compensation necessary therefore is carried out on the one hand at the connecting part to the tubing line, by the fact that the ball-shaped end part according to the exemplary embodiment of the present invention can be moved, prior to tightening of the coupling nut, perpendicular to the plane in which the tubing line is located, and thus makes possible installation without transverse forces. A motion of the tubing line along its extent, caused by axial forces, causes an elastic or plastic deformation as soon as the tubing line can no longer receive those axial forces along its extent.

Compensation for these forces is accomplished at the elongated opening according to the exemplary embodiment of the present invention of the holddown claw, which opening serves as a guide. The fuel injection valve, secured in the axial direction of the receiving orifice of the cylinder head, can move back and forth with a small deflection in this opening that serves as a guide; this represents a rotary motion about a cylinder head seal as fixed point. This ensures that a tolerance compensation in all planes is possible, specifically in such a way that no transverse or longitudinal forces that might occur during installation as a result of production tolerances act on the fuel injection valve. For this, movability of the tubing line in the connector regions must also exist; this is ensured by the system according to the exemplary embodiment of the present invention for connecting a fuel injection valve to a fuel distributor line.

DETAILED DESCRIPTION

Figure 1:
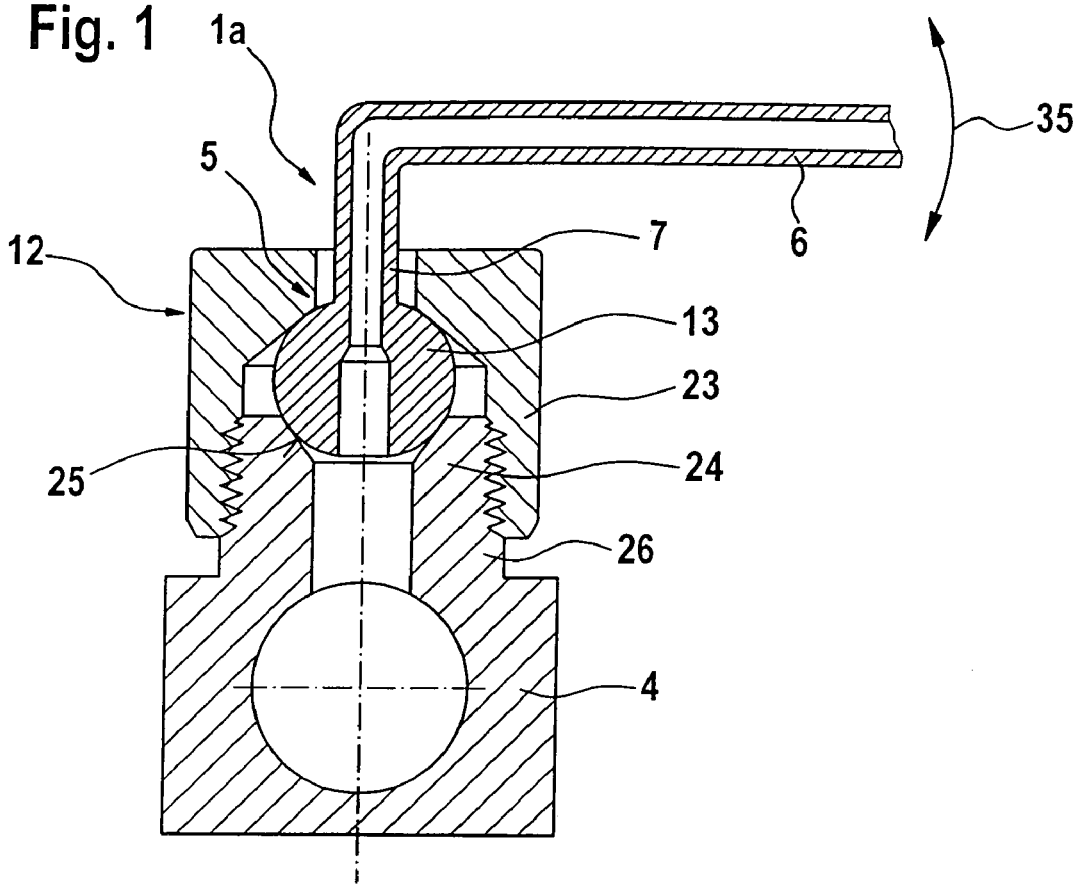
FIG. 1 shows a sectioned side view of a portion of a connector system according to the exemplary embodiment of the present invention for connecting a fuel distributor line to a tubing line leading to a fuel reservoir.

FIG. 1 is a side view, in a sectioned depiction, of a portion of a connector system 1, 1*a* according to the exemplary embodiment of the present invention for connecting a fuel distributor line 4 to a tubing line 6 leading to a fuel reservoir (not depicted further).

Connector system 1, 1*a* according to the exemplary embodiment of the present invention, for a fuel injection valve 2 to be inserted into a receiving orifice in a cylinder head for connection to a fuel distributor line 4 that encompasses a connector 5 to a tubing line 6 leading to a fuel reservoir, having a connecting part 7 for connection to tubing line 6, is characterized in that a holddown claw 8 has at its first end 9 an elongated opening 10 for reception of a connector piece 11, connected to the inflow-side end of the fuel injection valve, to fuel distributor line 4; and that connecting part 7 to tubing line 6 has a tube screw fitting 12 having an end piece 13.

End piece 13, which can be embodied as a spherical pivoting part, is movable, before the tightening of a coupling nut 23, perpendicular to direction 37 in which tubular line 6 extends, production tolerances being compensated for. Tubing line 6 is mounted, force-neutrally in terms of directions 35, 36 that extend perpendicular to direction 37 in which tubing line 6 extends, on a flange 26 at inflow-side end 24 of fuel distributor line 4. In a further exemplifying embodiment, end piece 13 can be embodied as a rotary part that deviates from complete spherical symmetry and has at its inflow-side end 29 an inflow-side spherical surface 31 and at its outflow-side end 30 an outflow-side spherical surface 32, radii 33, 34 of inflow-side spherical surface 31 and of outflow-side spherical surface 32 being different. The combination of the two connector systems 1, 1*a* according to the exemplary embodiment of the present invention causes connector system 1, 1*a* to be free of transverse forces, which means that the installed fuel injection valve 2 receives no forces as a result of the existing production tolerances of the individual components.

Figure 2:
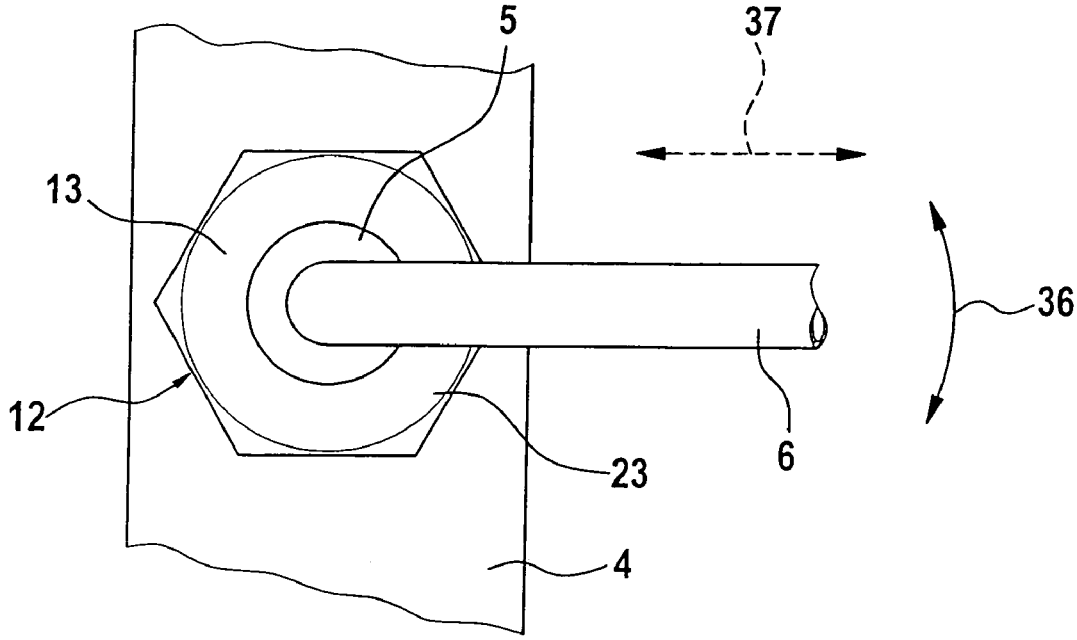
FIG. 2 shows a view of a portion of a connector system according to the exemplary embodiment of the present invention for connecting a fuel distributor line to a tubing line leading to a fuel reservoir.

FIG. 2 is a plan view of a portion of a connector system 1, 1*a* according to the exemplary embodiment of the present invention. A coupling nut 23, which is a component of a tube screw fitting 12 necessary for connection of a fuel distributor line 4 to a tubing line 6, is tightened after the production tolerances have been compensated for by the fact that spherical end piece 13 is displaced so that fuel injection valve 2 and fuel distributor line 4 no longer receive any forces perpendicular to the extent of tubing line 6 leading to the fuel reservoir (not depicted further). Arrows 35 and 36 illustrate the directions in which spherical end piece 13 can be moved for tolerance compensation prior to the tightening of coupling nut 23.

Figure 3:
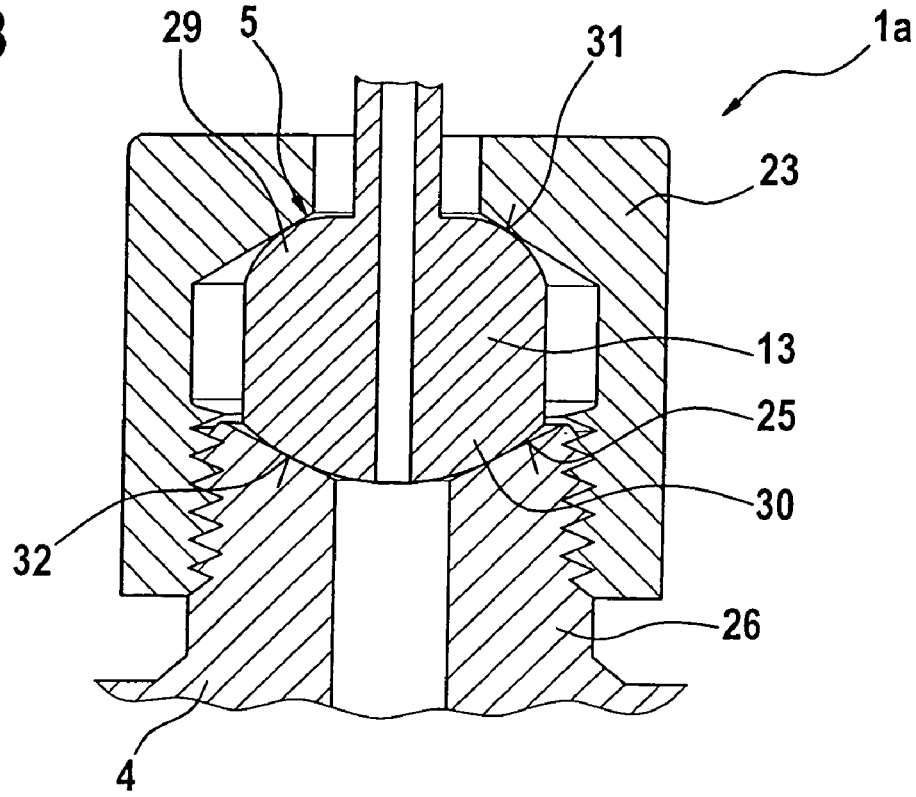
FIG. 3 shows a partial section of a portion of a connector system according to the exemplary embodiment of the present invention for connecting a fuel distributor line to a tubing line leading to a fuel reservoir.

FIG. 3 is a partial section through a portion of a connector system 1, 1*a* for connection of a fuel distributor line 4 to a tubing line 6 leading to a fuel reservoir (not depicted further). Tube screw fitting 12 necessary therefore has a coupling nut 23 that presses the partially spherically configured end piece 13 into a conical seat 25. Conical seat 25 delimits inflow-side end 24 of fuel distributor line 4, which end is embodied in the form of a flange 26 that forms the inflow to fuel distributor line 4. Coupling nut 23, end piece 13, and conical seat 25, which is disposed at an inflow-side end 24 of fuel distributor line 4, form a frictionally engaged connection.

Figure 4:
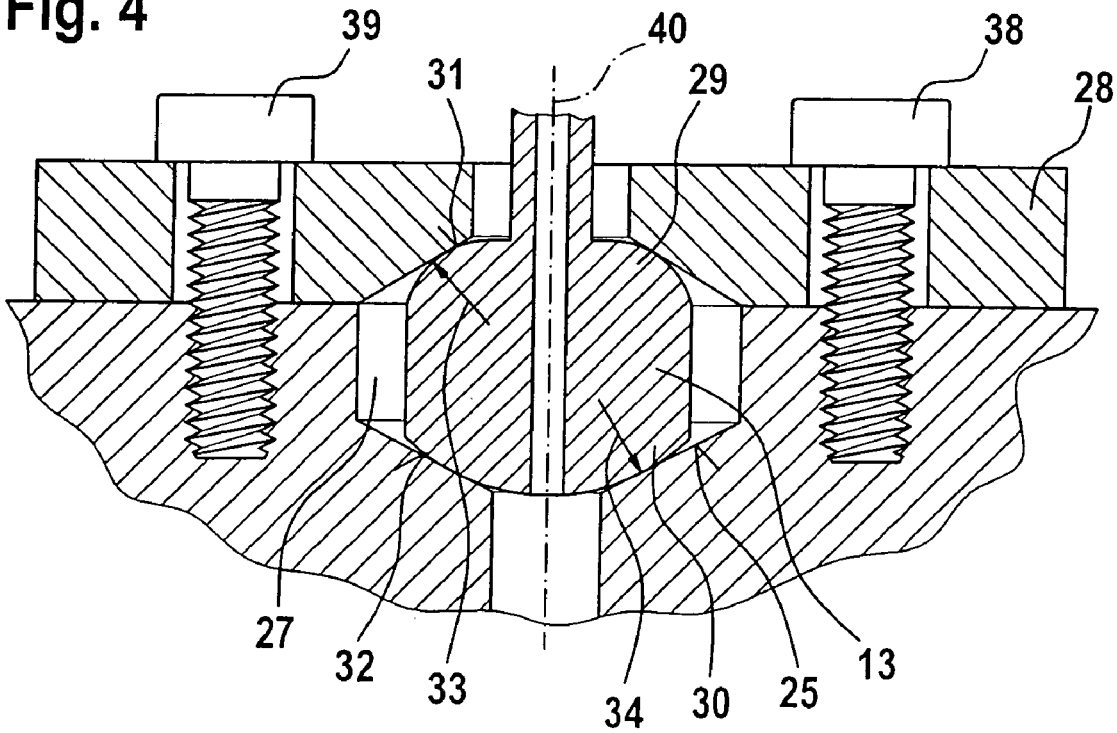
FIG. 4 shows a partial section of a second exemplifying embodiment of a portion of a connector system according to the exemplary embodiment of the present invention for connecting a fuel distributor line to a tubing line leading to a fuel reservoir.

FIG. 4 is a partial section through a second exemplary embodiment of a portion of a connector system 1, 1*a* for connecting a fuel distributor line 4 to a tubing line 6 leading to a fuel reservoir (not depicted further). Inflow-side end 24 of fuel distributor line 4 is embodied in the form of a recess 27 into which the at least partially spherical end piece 13 is placed and in which end piece 13 can be moved back and forth along directions 35 and 36 for tolerance compensation, before it is secured with the aid of a flat holddown 28 that is placed around the connector and around end piece 13 and is screwed into fuel distributor line 4 with at least two screws 38, 39. Screws 38, 39 may be disposed symmetrically with respect to a longitudinal axis 40 of recess 27. When screws 38, 39 on fuel distributor line 4 are tightened, end piece 13 is thus pressed onto conical seat 25 that delimits recess 27 of inflow-side end 24 of fuel distributor line 4.

Figure 5:
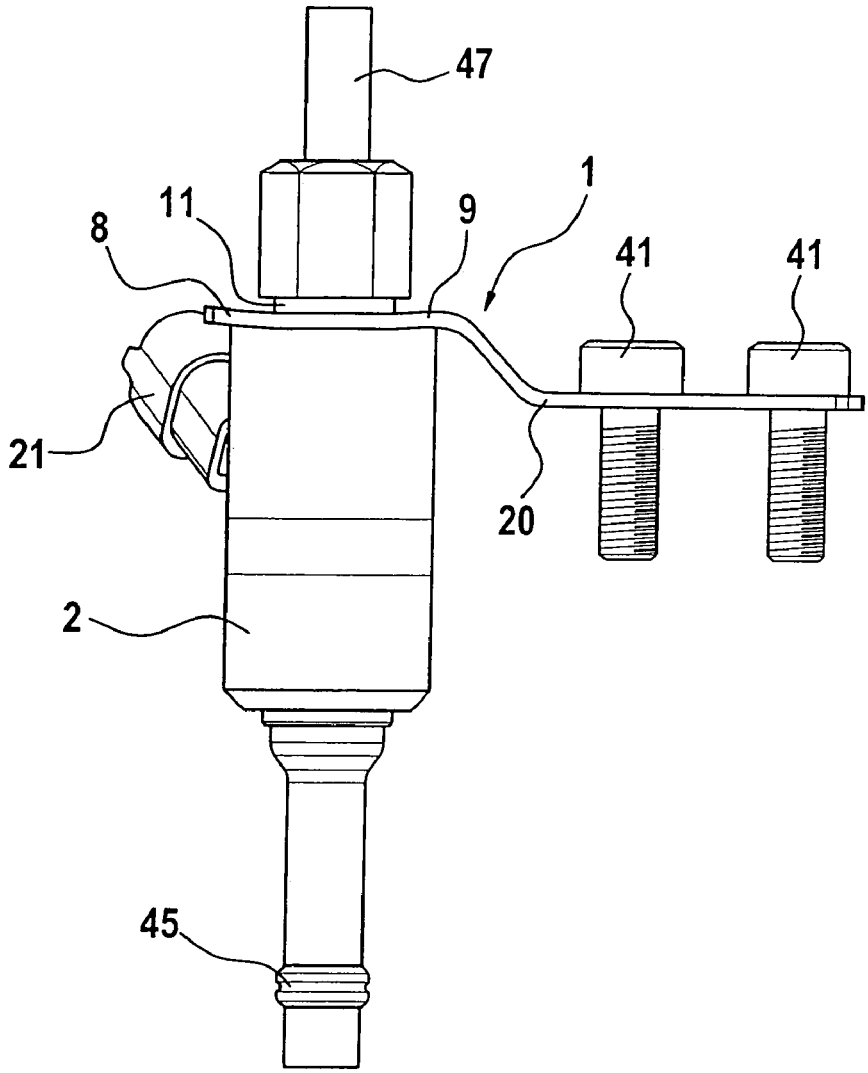
FIG. 5 shows a side view of a holddown claw that is part of a connector system according to the exemplary embodiment of the present invention for connecting a fuel distributor line to a fuel injection valve.

FIG. 5 is a side view, in a perspective depiction, of a holddown claw 8 that is part of a connector system 1, 1*a* according to the exemplary embodiment of the present invention for connecting a fuel distributor line 4 to a fuel injection valve 2. Holddown claw 8 is a bent and stamped sheet-metal component that is bolted with at least one screw 41 onto an end face (not depicted further) of the cylinder head. Holddown claw 8 has an elongated opening 10 that completely surrounds the inflow-side connector piece 11 to fuel distributor line 4, which piece is equipped with an external thread 42. Tube connector 44, equipped with an internal thread 43, is placed and screwed down onto connector piece 11 equipped with external thread 42. Before tube connector 44 is screwed down, production tolerances are compensated for, in direction 37 that extends parallel to the extent of tubing line 6 leading to the fuel reservoir, by the fact that fuel injection valve 2 is shifted a small distance in elongated opening 10 of holddown claw 8 along a longitudinal axis 18 of elongated opening 10. This translational motion of fuel injection valve 2 along longitudinal axis 18 of elongated opening 10 represents a rotary motion of fuel injection valve 2 with respect to cylinder head seal 45, with the result that connector system 1, 1*a* according to the exemplary embodiment of the present invention allows fuel injection valve 2 to be installed into a receiving orifice (not depicted further) of the cylinder head in a manner free of transverse and longitudinal forces.

Figure 6:
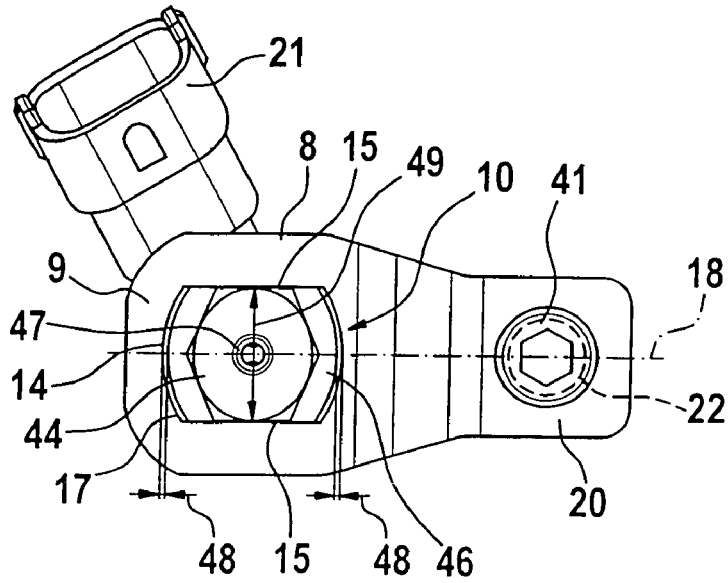
FIG. 6 shows a plan view of a holddown claw that is part of a connector system according to the exemplary embodiment of the present invention for connecting a fuel distributor line to a fuel injection valve.

FIG. 6 is a plan view of a holddown claw 8 that is part of a connector system 1, 1*a* according to the exemplary embodiment of the present invention for connecting a fuel distributor line 4 to a fuel injection valve 2, plug connector 21 for electrical contacting being evident at the side in this Figure. Holddown claw 8 is secured on the cylinder head (not depicted further) with a screw 41. Elongated opening 10 at a first end 9 of holddown claw 8 secures inflow-side connector piece 11 that is equipped with an external thread 42, which piece is inserted into fuel injection valve 2 for connection to fuel distributor line 4.

The connection of fuel injection valve 2 to fuel distributor line 4 is created by the fact that once tolerance compensation 48 has been carried out in a direction 37 parallel to tube connector 44 by displacement of fuel injection valve 2, tube connector 44 equipped with an internal thread 43 is placed and screwed down onto inflow-side connector piece 11. The diameter of elongated opening 10 formed by a partial circle 14 and two secants 15, extending perpendicular to a longitudinal axis 18 of holddown claw 8, corresponds to wrench width 49 of the wrench to be applied for screwing down. This diameter corresponds to the spacing of the two parallel-extending secants 15 that extend parallel to longitudinal axis 18 of holddown claw 8.

A further exemplary embodiment of elongated opening 10 extends over a partial ellipse and two secants extending parallel to its semi-major axis. The partial ellipse and the two secants define periphery 17 of elongated opening 10, the semi-major axis and longitudinal axis 18 of holddown claw 8 being coincident.

A second end 20 of holddown claw 8 is located on an end face (not depicted further) of the cylinder head, there being provided at second end 20 of holddown claw 8 at least one opening 22 that receives screw 41 which secures second end 20 of holddown 8 on the end face (not depicted further) of the cylinder head.

Figure 7:
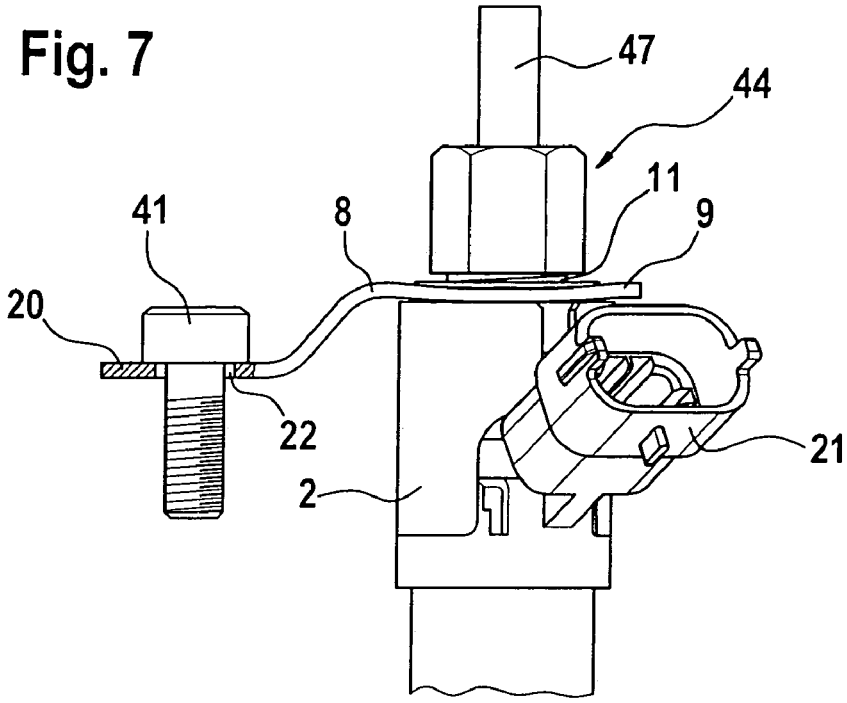
FIG. 7 shows a partial view of a holddown claw with a fuel injection valve, which claw is part of a connector system according to the exemplary embodiment of the present invention for connecting a fuel distributor line to a fuel injection valve.

FIG. 7 is a partial view, in a perspective depiction, of a holddown claw 8 with fuel injection valve 2, holddown claw 8 being part of connector system 1, 1*a* according to the exemplary embodiment of the present invention for connecting a fuel distributor line 4 to a fuel injection valve 2. Visible in the foreground is plug connector 21, which makes possible electrical contacting of fuel injection valve 2. Tube connector 44 is placed onto the inflow-side tubular connector piece 11 that is slid into fuel injection valve 2 and is not yet completely tightened, so that fuel injection valve 2 can be displaced parallel to longitudinal axis 18 of holddown claw 8, in elongated opening 10 provided in holddown claw 8, in order to compensate for production tolerances.

Figure 8:
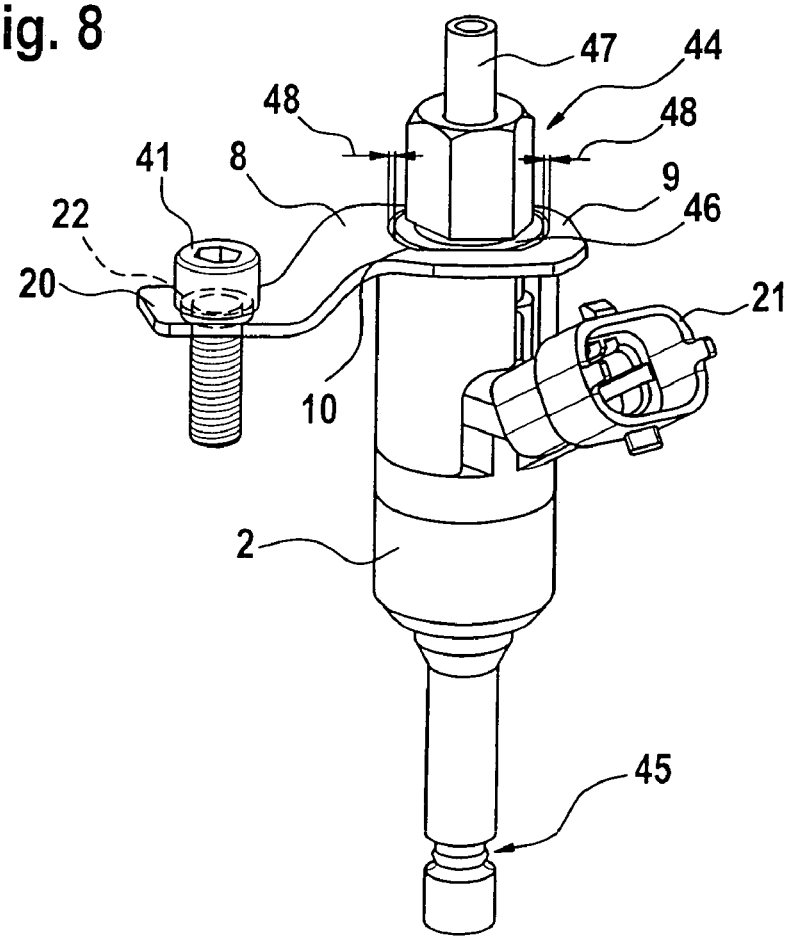
FIG. 8 shows an overall view of a holddown claw with a fuel injection valve, which claw is part of a connector system according to the exemplary embodiment of the present invention for connecting a fuel distributor line to a fuel injection valve.

FIG. 8 is a perspective depiction of an overall view of a holddown claw 8 with fuel injection valve 2 that is part of a connector system 1, 1*a* according to the exemplary embodiment of the present invention for connecting a fuel distributor line 4 to a fuel injection valve 2. Tube connector 44 is placed onto tubular connector piece 11 that is slid into fuel injection valve 2, and tightened after fuel injection valve 2 has been displaced parallel to longitudinal axis 18 of holddown claw 8 in longitudinal opening 10 in order to compensate for production tolerances.

Figure 9:
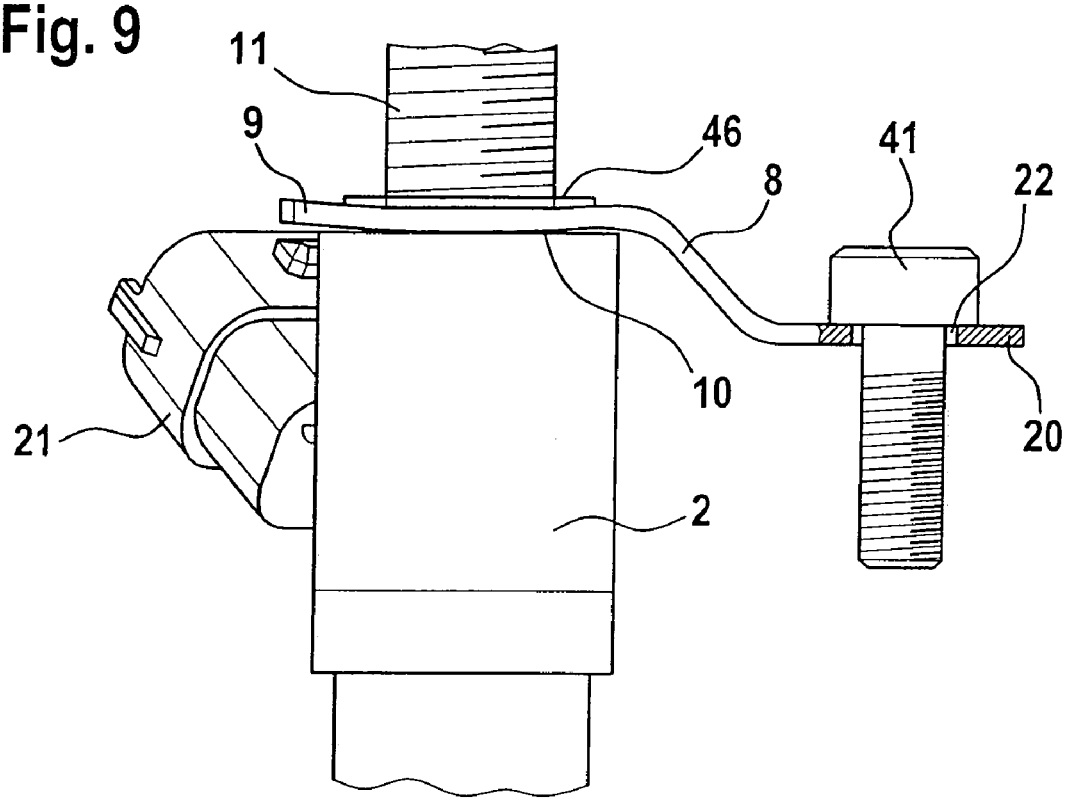
FIG. 9 shows a partial view of a holddown claw with a fuel injection valve, which claw is part of a connector system according to the exemplary embodiment of the present invention for connecting a fuel distributor line to a fuel injection valve.

FIG. 9 is a perspective depiction of a partial view of a holddown claw 8 with fuel injection valve 2 that is part of connector system 1, 1*a* according to the exemplary embodiment of the present invention for connecting a fuel distributor line 4 to a fuel injection valve 2. Elongated opening 10 in holddown claw 8 surrounds the tubular inflow-side connector piece 11 equipped with an external thread 42, which piece is inserted into the inflow-side end of fuel injection valve 2. Located at a second end 20 of holddown claw 8 is at least one opening for reception of a screw 41 that secures holddown claw 8 at its second end 20 to an end face (not depicted further) of the cylinder head.

Figure 10:
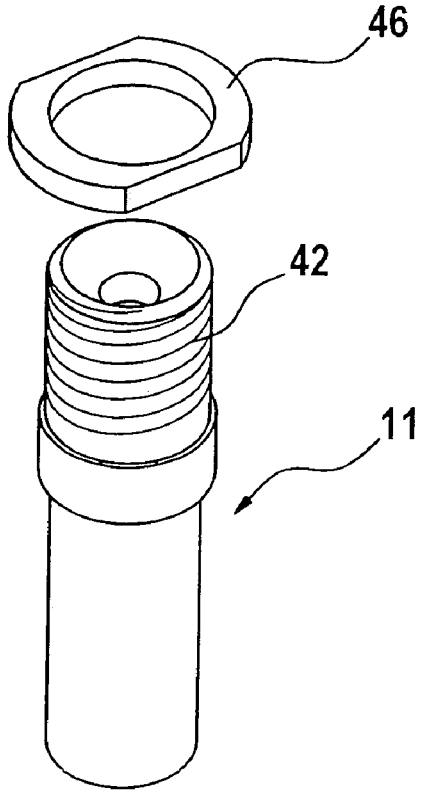
FIG. 10 shows an overall view of a connector piece for connecting a fuel injection valve to a fuel distributor line.

FIG. 10 is an overall view of an inflow-side tubular connector piece 11 that connects fuel injection valve 2 to fuel distributor line 4. The tubular inflow-side connector piece 11 is equipped at its inflow-side end with an external thread 42, and is inserted with its outflow-side end into the inflow-side end of fuel injection valve 2 after a ring 46, whose diameter is dimensioned such that it can be slid over external thread 42 of the tubular inflow-side connector piece 11, is welded below external thread 42.

Figure 11:
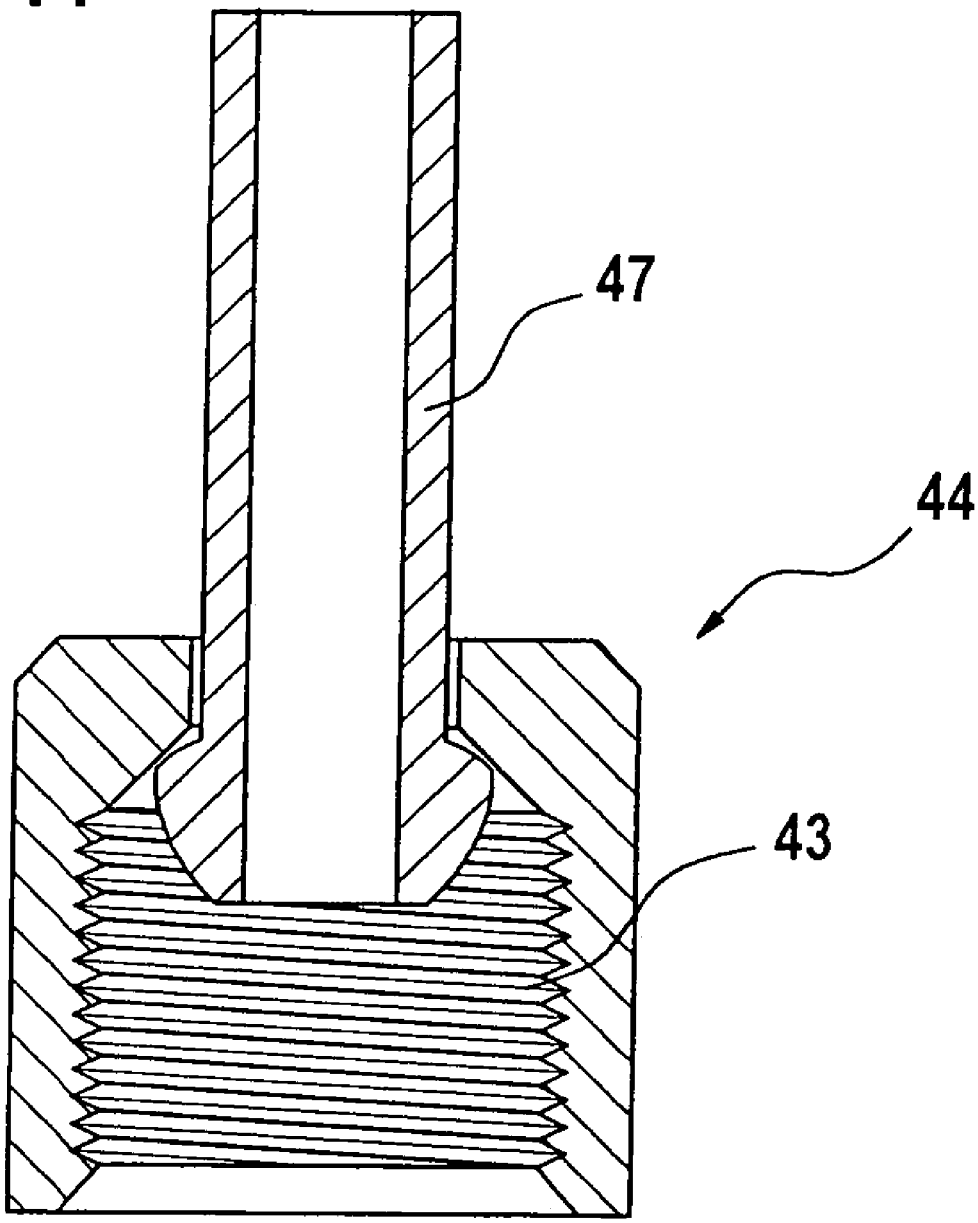
FIG. 11 shows a section through a tube connector to the fuel distributor line, to be screwed onto the connector piece.

FIG. 11 is a section through a tube connector 44 to fuel distributor line 4, which connector is to be screwed onto the tubular inflow-side connector piece 11. Tube connector 44 has an internal thread 43, and with its outflow-side end is placed and screwed down onto the tubular inflow-side connector piece 11. Inflow-side end 47 of tube connector 44 leads to fuel distributor line 4.

The present invention is not limited to the exemplary embodiments depicted. In particular, any combinations of the various features are possible.

What is claimed is:

1. A connector system for a fuel injection valve to be inserted into a receiving orifice into a cylinder head, for connection to a fuel distributor line that encompasses a connector to a tubing line leading to a fuel reservoir, comprising:

a connecting part for connection of the fuel distributor line to the tubing line; and a holddown claw having at its first end an elongated opening for receiving a connector piece, the connector piece for connecting an inflow-side end of the fuel injection valve to the fuel distributor line, the elongated opening of the holddown claw completely surrounding the connector piece;

wherein the connecting part to the tubing line includes a tube screw fitting having an end piece.

2. The connector system of claim 1, wherein the connector system is free of transverse forces.

3. The connector system of claim 1, wherein the holddown claw includes a bent component.

4. The connector system of claim 1, wherein the holddown claw is made of sheet metal.

5. The connector system of claim 1, wherein the holddown claw includes a stamped component.

6. The connector system of claim 1, wherein the opening is bordered by a partial circle and two secants.

7. The connector system of claim 6, wherein the two secants are oriented parallel to a longitudinal axis of the holddown claw.

8. The connector system of claim 1, wherein a periphery of the elongated opening of the holddown claw is formed from a partial ellipse and two secants extending parallel to its semi-major axis, a semi-major axis and a longitudinal axis of the holddown claw being coincident.

9. The connector system of claim 1, wherein a second end of the holddown claw rests on an end face of the cylinder head.

10. The connector system of claim 1, wherein at a second end of the holddown claw, at least one opening is provided for mounting the holddown claw on the end face of the cylinder head with the aid of a screw.

11. The connector system of claim 1, wherein the tube screw fitting has a coupling nut.

12. The connector system of claim 1, wherein the coupling nut, the end piece, and a seat that is disposed at an inflow-side end of the fuel distributor line form a frictionally engaged connection.

13. The connector system of claim 12, wherein the inflow-side end of the fuel distributor line is embodied in the form of a flange.

14. The connector system of claim 12, wherein the inflow-side end of the fuel distributor line is embodied in the form of a recess.

15. The connector system of claim 12, wherein the seat on the inflow-side end of the fuel distributor line is embodied conically.

16. The connector system of claim 14, wherein the end piece is secured in the recess of the fuel distributor line with a flat holddown and at least two screws.

17. The connector system of claim 12, wherein the end piece is spherical.

18. The connector system of claim 12, wherein the end piece is a pivoting part.

19. The connector system of claim 18, wherein the end part has an inflow-side spherical surface at an inflow-side end, and an outflow-side spherical surface at an outflow-side end.

20. The connector system of claim 19, wherein the inflow-side spherical surface and the outflow-side spherical surface have different radii.

* * * * *